United States Patent [19]

Shell et al.

[11] 4,024,051

[45] May 17, 1977

[54] USING AN ANTIFOULANT IN A CRUDE OIL HEATING PROCESS

[75] Inventors: Don C. Shell, Richmond; Edward C. Hayward, Houston, both of Tex.

[73] Assignee: Nalco Chemical Company, Oak Brook, Ill.

[22] Filed: Nov. 20, 1975

[21] Appl. No.: 633,933

Related U.S. Application Data

[63] Continuation-in-part of Ser. No. 539,227, Jan. 7, 1975, abandoned.

[52] U.S. Cl. ..... 208/348; 208/48 AA; 208/187; 208/188; 208/354

[51] Int. Cl.[2] ..... C10G 7/00

[58] Field of Search ..... 208/348, 48 AA, 187, 208/188

[56] References Cited

UNITED STATES PATENTS

| | | | |
|---|---|---|---|
| 2,901,424 | 8/1959 | Burke | 208/348 |
| 3,261,774 | 9/1970 | Newkirk et al. | 208/48 AA |
| 3,390,073 | 6/1968 | Godar et al. | 208/48 R |
| 3,531,394 | 9/1970 | Koszman | 208/48 AA |
| 3,558,470 | 1/1971 | Gillespie et al. | 208/48 AA |
| 3,647,677 | 3/1972 | Wolff et al. | 208/48 AA |
| 3,798,153 | 3/1974 | Arndt et al. | 208/48 AA |

*Primary Examiner*—Herbert Levine

*Attorney, Agent, or Firm*—Hill, Gross, Simpson, Van Santen, Steadman, Chiara & Simpson

[57] ABSTRACT

Inorganic phosphorus-containing acids and salts thereof in small amounts function as antifoulant additives in crude oil systems employed as feedstocks in petroleum refining which are subjected to elevated temperatures of from about 100° to 1500° F. and which are prone to produce fouling material that deposits and accumulates upon the surfaces of petroleum processing equipment, such as heat transfer equipment and the like. Such additives not only inhibit and suppress fouling but also reduce fouling in previously fouled refining systems.

7 Claims, No Drawings

USING AN ANTIFOULANT IN A CRUDE OIL HEATING PROCESS

RELATED APPLICATION

This is a continuation-in-part application of our earlier filed U.S. application Ser. No. 539,227, filed Jan. 7, 1975 now abandoned.

BACKGROUND OF THE INVENTION

In petroleum refining, the crude oil systems employed as feedstocks are prone to produce material that deposits and accumulates upon the surfaces of heat transfer equipment contacted therewith resulting in the fouling of petroleum process equipment. In normal, continuous use, for example, the heat exchangers used in almost all crude oil unit processes suffer gradually increasing losses in efficiency, heat transfer, pressure drop, and throughput owing to deposition of material on the inner surfaces thereof. Consequently, crude oil process units must be periodically shut down and the deposits removed or the units replaced. Such fouling of heat exchanger, and also such equipment as furnaces, pipes, reboilers, condensers, compressors, auxiliary equipment, and the like, is costly by reason of the loss of production time and the man hours required for disassembly, cleaning and reassembly of unit process equipment components. The equipment is usually fabricated of carbon steel, stainless steel or aluminum.

The fouling is generally attributed to the presence of unstable components, such as oxidized derivatives of hydrocarbons, the inorganic impurities present in hydrocarbon fractions, the presence of olefinic unsaturated hydrocarbons or their polymeric derivatives, or the like. Thus, almost all crude oil and fractions thereof, as well as process cuts prepared from such, contain minor amounts of readily oxidized and oxidizable hydrocarbon constituents. Furthermore, almost all crude oil contains small amounts of dissolved oxygen, sulfur and metals, in a free and/or chemically combined state. If chemical and/or thermal treatment is involved, the olefinic substitutes may be polymerized.

The use of certain inorganic phosphorus-containing acid materials as antifoulant suppressant additives to mineral hydrocarbon mixtures employed as refinery feedstocks has heretofore been proposed. Thus, Wolff et al U.S. Pat. No. 3,647,677 teaches the addition of such anhydride materials as $P_2O_5$ or $P_2S_5$ to crude oil for temperatures above 700° F. Koszman et al U.S. Pat. No. 3,531,394 teaches addition of phosphorus materials to petroleum and steam for temperatures ranging from 1000° to 1700° F. in steam cracking. Such additive materials Koszman et al state are in the vapor phase. Gillespie et al in U.S. Pat. Nos. 3,558,470 and 3,645,886 teach the addition of mixtures of (I) phosphorus acid and (II) either a condensation product of carboxylic acid component with alkylene polyamine or a fatty acid ester of alkanol amine. Gillespie et al never use only phosphorus acid as an additive.

So far as we know, no one has heretofore ever employed inorganic phosphorus acid materials, particularly salts thereof such as amine salts as antifoulant reducing additives in crude oil materials in conventional processes thereof. Such phosphorus acids, and salts thereof, have now been found characteristically to display surprising and very useful antifouling reducing activity in crude oil materials. Thus, not only do these materials generally inhibit and suppress and even prevent, fouling when in crude oil materials, but also they unexpectedly appear to reduce the fouling in previously used and fouled crude oil refinery processing equipment. Such additives in combination with one another can sometimes be considered to be arguably synergistic in some of these effects, and applications, as those skilled in the art will appreciate. The art of reducing existing fouling in refining streams is very complex and the reasons why a particular antifoulant system works to reduce fouling effectively in some mineral hydrocarbon mixtures, but perhaps not in others, are not now known.

BRIEF SUMMARY OF THE INVENTION

In one aspect, this invention relates to an improved process for reducing the fouling tendencies of crude oil materials during normal and conventional petroleum refining operations thereof of the type using elevated temperatures ranging from about 100° to 1500° F.

This process involves the step of adding to and mixing with a crude oil material a small amount of an inorganic phosphorus containing acid compound and/or a salt thereof. Examples of suitable such acid compounds include phosphoric acid, phosphorus acid, thiophosphoric acid, thiophosphorous acid, anyhydrides of such acids, such as $P_2O_5$, $P_2S_5$, and the like.

Examples of suitable phosphoric acids includes metaphosphoric acid, pyrophosphoric acid, orthophosphoric acid, and the like.

Alakli metal and ammonium salts of such inorganic phosphorus acid materials may be used, including, for example, alkali metal polyphosphates, alkali metal tripolyphosphates, tetra (alkali metal) pryrophosphates and the like. A preferred alkali metal is sodium.

Preferred salts are amine salts. Amine salts of such acid compounds involve amine compounds containing at least one primary (preferred) or secondary amine group.

Such additive compound used in this invention is preferably employed in an amine salt form. When in such form, such compound typically contains from about 1 to 50 carbon atoms per molecule, and preferably from about 8 to 20. More preferably, the amine is a primary amine which contains at least one alkyl group per molecule, and each such amine alkyl group contains from 8 through 14 carbon atoms each.

Acid compounds, whether or not in an amine salt form, wherein the phosphorus atom(s) present have a valence of five are preferred over compounds wherein the phosphorus atoms present have a valence of three. As used herein, the term "lower" has reference to an organic group containing less than 7 carbon atoms each.

The process further involves the step of heating such a resulting mixture to such elevated processing temperatures, such as from about 100° to 1500° F. and preferably from about 200° to 900° F. The heating is preferably conducted in the presence of previously fouled crude oil processing equipment. These steps may be practiced sequentially or simultaneously.

In another aspect, this invention relates to compositions comprising mixtures of a major amount of crued oil material with a small mount of at least one such additive compound, and, also, to such compositions which have been heated to a temperature ranging from about 100° to 1500° F.

DETAILED DESCRIPTION

The Mineral Hydrocarbon Mixture and Processing Thereof

The present invention characteristically may be practiced advantageously with any crude oil material, such as one selected from the group consisting of crude oils and reduced crude oils.

Typically, the total amount of such additive material added to a crude oil material is less than about 500 parts per million total weight basis. Preferably, the total amount of such additive material admixed with crude oil material ranges from about 2 to 50 parts per million (same basis). Heating times can vary enormously, as those skilled in the art of petroleum refining will readily appreciate, but are generally in the range of about from a few seconds to several hours, though longer and shorter time can be involved.

As used herein, the term "crude oil" can be considered to have reference to materials used as starting feedstocks for a petroleum crude oil refining operation, such as a petroleum having a substantially naturally occurring composition and which composition has not been appreciably altered through the use of distillation or pyrolysis. Examples of crude oils include many materials, such as refinery battery limit crudes (e.g. a crude as it exists in storage vessels preceding refining), degassed crude oils (e.g., a crude which has been subjected to temperatures typically in excess of from about 90° to 125° F. to remove therefrom low boiling hydrocarbons, such as lower alkanes and other low volatiles), tar sand crudes (e.g. a product obtained from a destructive distillation of a tar sand), condensate crudes (e.g. a crude obtained by condensation of heavy ends from a natural gas well), shale oils, (e.g. a crude oil obtained from oil shale by destruction distillation followed by hydrotreating), desalted crude oils (e.g. a crude oil which has been subjected to a procedure whereby the content of mineral salts present in a starting crude oil is reduced typically to a salt content not above 5 pounds per 1000 barrels, although the amount of salt remaining in de-salted crude can vary widely as those skilled in the art of petroleum refining will readily appreciate), and the like. Conventional terms describing a crude oil in this art of petroleum sometimes overlap on one another and are not well defined. Presently preferred crude oil starting feedstocks for the present invention include battery limit crude oil, degassed crude oil, and desalted crude oil.

Similarly, as used herein, the term "reduced crude oil" can be considered to have reference to a starting crude oil feedstock which has been subjected to distillation at temperatures which are generally above those employed for making a degassed crude oil using temperatures as above indicated, such as a residual crude oil (usually a liquid) which has not been substantially altered except as a result of heating and removing material therefrom by distillation or pyrolysis. Examples of reduced crude oils include a wide variety of materials, as those skilled in the refinery art will appreciate readily, such as topped crude oils (e.g. a product which results after gas oils boiling in the range of from about 350° to 450° F. have been removed from a crude oil by fractional distillation), atmsopheric residues (e.g. a product which results from the fractional distillation of a crude oil in an atmospheric pipe still and which boils above a temperature in the range from about 350° to 650° F.), viscous pitches (e.g. a product which results from fractional distillation of an atmospheric residue in a vacuum still and which boils above a temperature in the range from about 1000° to 1500° F. at pressures of from about 1 to 5 psia), and the like. Viscous pitches can be considered to include coker feedstocks. Presently preferred reduced crude oils include topped crude oils, atmospheric residues and viscous pitches.

The processing of crude oil materials in a refinery is a relataively well developed art. Characteristically and usually, the processing of crude petroleum comprises a successive series of steps. These steps characteristically and preferably are as follows:

A. heating a crude oil in at least one heat exchanger to a temperature typically in the range from about 100° to 200° F., B. desalting the crude oil typically and preferably by the substeps of
   1. turbulently mixing the crude oil which has been preferably first pre-heated as above indicated as typically from about 3 to 8 parts by weight of water for each 100 parts by weight of such crude oil to form an emulsion of the water in oil type,
   2. breaking said emulsion through the use of chemical agents, electrical means, or some combination thereof, and
   3. separating the resulting aqueous phase from the resulting crude oil phase, C. further heating the resulting crude oil in at least one post desalter heat exchanger to a temperature typically in the range from about 200° to 500° F., D. still further heating the resulting crude oil in a furnace to a temperature typically in the range from about 500° to 700° F., E. charging the so-heated crude oil to an atmospheric still wherein such crude oil is progressively fractionally distilled at temperatures typically in the range from about 300° to 650° F. under pressures typically ranging from and including atmospheric up to about 40 psia and collecting the distillates until an atmospheric residue results which boils above a temperature typically in the range from about 300° to 650° F, F. heating said atmospheric residue in a vacuum furnace to a temperature typically in the from about 650° to 800° F. while maintaining a subatmospheric pressure of from about 5 to 14 p.s.i.a. typically, G. charging the so-heated atmospheric residue to a vacuum still wherein such atmospheric residue is progressively fractionally distilled at a temperature typically in the range from about 800° to 1000° F under pressures typically in the range from about 1 to 5 psia. and collecting the distillates until a viscous pitch results typically boiling in the range from about 1000° to 1500° F. at a sub-atmospheric pressure of typically from about 1 to 5 psia, and H. progressiveily heating the viscous pitch in a zone at temperatures typically ranging fom bout 860° to 900° F. at pressures typically ranging from about 50 to 350 psig for a time ranging from about 1 second to 1 ½ hours.

In the case of step (G), the heating can occur either in a coker zone or in a thermal cracking zone. In the case of a coker zone, the heating is pyrolytic, and the distillates are collected, until a final solid residue is obtained which is a coke. In the case of a thermal cracking zone, the process involved in termed "visbreaking" and the distllates are collected without changing the fluid nature of the starting viscous pitch (as by forming coke). Residence times of the charged material (initially viscous pitch) in a coker zone typically extends for periods of time more than 10 seconds with common coking times ranging from about 45 minutes to 4 ½ hours. Residence times of startin pitch in a visbreaking operation in a thermal cracking zone typically are shorter than about 10 seconds maximum.

These crude oil and reduced crude oil processing steps, as indicated, are well known to the art of petroleum refining and do not constitute as such part of the present invention. Those skilled in the art will appreciate that many variations, etc., can be used in any given refinery operation, involving, for examples, additional steps, substitute steps, recycle loops, and the like. The above summary is merely representative, but characteristic, of the sequence of steps typically found in a refinery when processing crude oil. Petroleum processing is discussed in such reference works as that by Nelson entitled "Petroleum Refinaery Engineering", see for example, chapter 7, pp. 248–260; chapter 8, pp. 265–268; chapter 17pp. 547–554 and chapter 19, pp. 678;14 693. All such crude oil processing steps characteristically cause fouling of refinery equipment in absence of an additive or the like, as those skilled in the art well appreciate.

Fouling deposites apparently occur frequently at temperatures between about 200° and 900° F. The types of equipment affected most frequently include heat exchange surfaces, such as indicated above. The fouling deposits themselves are typically and principally polymerization products and are characteristically black in color. some are initially gummy masses which convert to coke-like masses at elevated temperatures. Inorganic portions of such deposits frequently containt components, such as silica, iron-oxides, iron sulfides, calcium oxide, magnesium oxide, inorganic chloride salts, sodium oxide, alumina, sodium sulfate, copper oxides, copper salts, and the like. These deposits are not readily solubilized by common organic solvents and these deposits are distinguiable from the corrosion and sludge formation sometimes occuring in finished products. Conventional antioxidants, stabilizing chemicals, and th like are characteristiclly relatively ineffective as antifoulants.

During a distillation or pyrolysis carried out with a crude oil material containing such an additive material, this additive material is characteristically not carried over in the vapors evolved, but remains instead with the residue (reduced crude oil) involved. Chemical and physical changes may occur, of course, in such additive material during a given distillation or pyrolysis operaton, but it is now theorized (and there is no intent herein to be bound by theory) that by-products, degradation products, and the like, are not appreciably carried over with a vapor phase stream removed during distillation or pyrolysis operation from a reduced crude oil.

Examples of suitable amines for salts used as starting materials include a n-dodecylamine; n-tetradecylamine; n-hexadecylamine; lauryl amine, myristyl amine; palmityl amine; stearyl mine; oleyl amine; cocunut oil amine; tallow amine; hydrogenated tallow amine; cottonseed oil amine; dilauryl amine; dimyristyl amine; dipalmityl amine; distearyl amine; dicoconut amine; dihydrogenated tallow amine; octyl methylamine; octadecyl methyl amine; hexylethyl amine; soya amine 10%; octadecyl 10% octadecaenyl 35%; octadecadienyl 45%; ethyl amine; diethyl amine; morpholine; butyl amine; isopropylamine; diisopropylamine; N-methyl morpholine; triethylamine; eaminoethyl ethanolamine; diethanolamine; diethyl ethanolmine; diisopropanol amine; diemthyl-ethanolamine; dimethyl isopropanolamine; N-hydroxy ethyl morpholine; N-methyldiethanolamine; monoethanolamine; monoisopropanolamine; triethanolamine; triisopropanolamine; 1,1-dihydroxy-methyl ethylamine; 1,1-dihydroxymethyl-n-propylamine; polyglycolamine ($H_2NCH_2CH_2$-O-$CH_2CH_2)_nOH$ where $n = 1$ to 10 inclusive; pyrrolidone; 5-methyl-2-oxazolidone; 2-oxazoladone; imidazole; polyamines of the class (1)

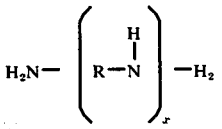

where R is an alkylene radical selected from among $-CH_2-CH_2-$, $-CH_2CH_2CH_2-$, and $-CH_2-CH_2-$, $-CH_2CH_2CH_2-$, and $-CH_2-C(CH_3)-CH_2-$ and x is an integer of 1–5;

5-benzimidazole; 2-hydroxyethyl imidazole; 2-methyl imidazole; pyrazine; pyridine; 2-imidazoline; cyclohexyl amine, and the like.

On preferred class of amines are highly substituted imidazolines such as those defined by one of the following formulas:

(2)

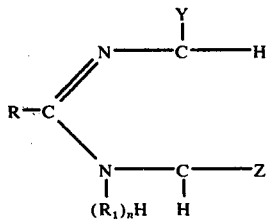

(3)

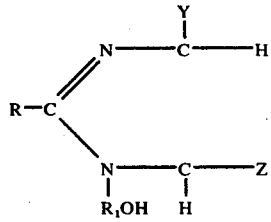

(4)

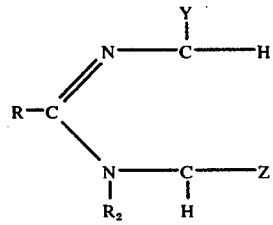

wherein formulas (2), (3) and (4) above, R is an aliphatic group of from about 1 to 22 carbon atoms in chaim lenght, Y and Z are selected from the group consisting of hydrogen and lower aliphatic hydrocarbon groups of not nore than 6 carbon atoms in chain length, $R_1$ is an alkylene radical of about 1 to 6 carbon atoms, $R_2$ is a radical selected from the group consisting of R and hydrogen, and *n* is an integer of from about 1 to 50. Imidazolines of the type shown in formuls (2), (3) and (4) are conviently prepared by reacting a monocaraboxylic acid such as a saturated or unsaturated fatty acid with an alkylene polyanine or hydroxyalkyl alkylene diamine in accordance with well-known methods. The product imidazolines may be further reacted via oxyalkylation to produce other useful derivatives. Methods of preparing imidazolines of this type are given in the article , "The Chemistry of the s-Imidazolines and Imidazolidines", by R. J. Ferm and J. L. Riebsomer, Chemical Reviews, Vol. 54, No. 4, August, 1954. Particulalry useful imidazolines for use in the practice of the invention are those described in Wilson U.S. Pat. Nos. 2,267,965 and 2,355,837. Two typical imidazolines of the type described by the formulas above are 1-(2 hydroxyethyl)-coco imidazoline and 1-(2 -hydroxyethyl)-2 -tall oil imidazoline, both of which compounds are conveniently prepared using the teachings of Wilson U.S. Pat. No. 2,267,965.

For purposes of illustrating several other types of typical imidazolines that may be used, the following are given by way of example:

1-(2-hydroxyethyl)-2-undecyl imidazoline
1-(2-hydroxyethyl)-2-tridecyl imidazoline
1-(2-hydroxyethyl)-2-pentadecyl imidazoline
1-(2-hydroxyethyl)-2-heptadecyl imidazoline
1-(2-aminoethyl)-2-heptadecyl imidazoline
1(2-aminoethyl)-aminoethyl-1-2-undecyl imidazoline
1-(2-aminoethyl)-aminoethyl-1-2-tridecyl imidazoline The fatty acids are most generally reacted with a polyalkylene polyamine such as diethylene trimine, triethylene tetramine, tetraethylene pentanine, or mixtures thereof, or a polyamine alcohol such as aminoethyl ethyanolamine. The amine make likewise be substituted with lower alkyl groups.

A particularly preferred class of amines are tertiary-alkyl primary amines. The tertiary-alkyl primiary amines have the formula:

(5)

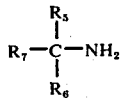

More specifically, the tertiary-alkyl primary amine consitutues a component wherein $R_5$ amd $R_6$ are lower alkyl groups, usually methyl groups, and $R_7$ constututes a long chain alkyl radical composed of 8 to 19 carbons. Tertiary-alkyl primary amines which have been found eminently suitable for the instant invention are "Primene 81-R" and "Primene JM-T". "Primene 81-R" is reported by its manufacturer to be composed of principally tertary-alkyl primary amines haing 11–14 carbons and has a molecular weight principally in the range of 171–213, a specific gravity at 25° C. of 0.813j a refractive index of 1.423 at 25° C. and a neutralization equivalent of 191. "Primene JM-T" is reported by the manufacturer to be composed of tertiary-alkyl primary amines having 18–22 carbons with a molecular weight principally in the range of 269–325, a specific gravity at 25° C. of 1.456 and a neutralization equivalent of 315.

The primary consitutent of "Primene 81-R" is reported to be:

(6)

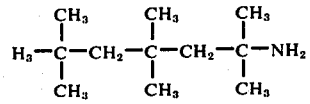

The primary constituent of Primene JM-T is reported to be essentially the same structure as Primene 81-R, but with 22 carbons. "Primene" is a trademark of the Rohm & Haas Company for its brand of tertiary alkyl primary amines.

The present invention is not concerned with the particular method by which the starting additive mterials are produced. In general such materials and methods for their preparation are well known to the prior art. While in general, amine salts of such inorganic phosphorus-containing acids may as not appear to be as active as antifoulants as do the acidic materials themselves, the amine salts do have desirable advantages, such as apparently little or not tendency to cause equipment corrision problems or the like.

Mixing and the Compositions

Only relatively small amounts of additive materials are used to produce a reduction both in fouling deposits and/or a suppression of fouling material in the typical practice of this invention. Preferably, the total amount of such additive compounds present in a total mixture ranges from about 2 to 50 parts per million by weight, and more preferably ranges from about 4 to 10 parts per million, though larger and smaller amounts of such additives may be employed, as those skilled in the art will appreciate. Owing to the complexity of the variables involved, it is not possible to indicate optional concentrations of additives for all possible use situations.

Mixing of additive material with crude oil material may be accomplished by any convenient or conventional means before or during a heating of such materials. Preferably, such asdditive compound(s) are admixed in a previously prepared solution form. Typically, such additive compound(s) are injected through a chemical feed pump or the like ahead of the heat exchangers subject to fouling, or the like. Preferably, injecton takes place as far back in a system as possible. To assure substantially complete dispersion, a suitable injection point should be selected, such as into the suction regions of a charge pump. Sleeve-type arrangements termed "quills" may be preferably used to inject additives into process streams which extend into a line to cause better mixing. The additive compound or compounds are preferably fed in solution form using a liquid which is soluble or miscible with the mineral hydrocarbon mixture being treated. When large pump feeding rates are involved, one may employ more dilute solutions than at lower pumping rates.

The solvent used for such a solution of additive material can vary widely. Preferably the solvent is non aqueous though water can be used as a solvent liquid. In general, such solvent should have a higher boiling point than that of the more volatile components of the process stream into which the resulting solution is to be injected. A presently preferred type of organic solvent is one which has a boiling point high enough to be suitable for many injection locations such as a heavy aromatic hydrocarbon mixture (of the type derived from petroleum refining) having a boiling point in the range from about 350° to 550° F. Preferably, such has a sulfur content not greater than about 1 weight percent (based on total solvent weight). Typically and preferably such a solvent is comprised of at least 90 weight percent (total solvent weight basis) of six membered aromatic rings which nay each be substituted by at least one alkyl group having from 3 through 7 carbon atoms each as those skilled in the art will appreciate. The total amount of additive compound(s) dissolved a given solution can vary widely, but usually and conveniently, this amount falls in the range of from about 10 to 40 percent by weight of additive compound(s) per 100 weight percent total solution. Neither the solvent nor the additive compounds appears to affect generally the useful properties of either the crude oil material to which such a solution is added or the processed crude oil containing residual materials derived from such a solution.

When additive material is fed to a process stream having a temperature above about 200° F., it is preferred to have a nipple connecting the feedline to the process line which is made of stainless steel. Starting charge dosages are preferably greater than subsequent dosages.

In one preferred mode of practicing this invention, at a given injection point, an initial dosage rate of from about 2 to 50 parts per million of additive material is used. After an operational period of, for example, about 1 to 2 weeks, this dosage rate can be reduced to a level of from about 5 to 20 parts per million. Thereafter, for an extended operating period, the level of fouling, or the rate of fouling, surprisingly but characteristically does not appear to change substantially and remains substantially below the level of fouling associated with refinery crude oil material processing which does not employ an additive compound used in this invention. Such an antifouling maintenance procedure appears to be new in this art and represents one of the advantages of the present invention. The reason why such a non-fouling effect is achieved with such reduced dosage rates (compared to starting dosage rates) is not known, but it theorized that this effect may possibly be associated with micellular agglomerates building up on the inside surfaces of refinery equipment contacted with an additive compound.

Also, in another preferred mode of practicing the present invention, additive material is mixed simultaneously with a crude oil material feed stream being processed at various successive locations therealong. For example, such additive material can be first injected into and mixed with a crude oil stream before such undergoes the initial heating which is identified above as step (A). Thereafter, and simultaneoulsy, such material may also be injected into a process stream before each of the steps identified above as steps (B) through (H) using a same or similar rate of addition at each injection location. If such material is not so injected at each such location, it is preferred to inject such at least before steps (A), (C), (F) and (H).

The additive compounds operate in a manner not altogether clear, and, while there is no intent to be bound by theory herein, it is theorized that compounds function to reduce fouling by retarding organic polymer formation and also by dispersing organic and inorganic sludge-like material which would otherwise build up on heat exchange surfaces. Build up rates of deposits of fouling material on interior surfaces of processing equipment is usually such that months or even years of actual operation time may be involved before a shut down is forced for reasons associated with a build up of fouling deposits, but those skilled in the art will appreciate that fouling can occur rapidly, so that equipment operational failure can occur in a matter of even days under conditions of heavy fouling. The additive compounds used in this invention are well suited for use with heat transfer surfaces of ferrous metals (such as stainless steel or carbon steel) or of aluminum. The additive compounds appear to be particularly effective as antifoulant reducers at tube wall temperatures below about 1200° F and at oil temperatures below about 600° to 950° F, though they can be used as antifoulants at higher temperatures, as taught herein.

In a most preferred mode of practicing this invention, the additive material is added to a crude oil material being processed in previously fouled refinery equipment is characteristically achieved by this invention. Such a reduction is shown in such ways as reduced pressure drop across a given unit or zone, increased temperature (better heat transfer) across a given unit (such as a heat exchanger) or zone, reduced furnace fuel consumption, and the like.

After being heat processed at temperatures ranging from 100° to 1500°F, a composition of this invention which is initially comprised of crude oil type material and additive material appears to have undergone chemical change but the exact nature of such changes is not now known. For one thing, differential thermal analysis of certain heated compositions comprising crude oil or reduced crude oil with additive material above suggests that there is a possibility or change in structure at temperatures below those occuring in the hotter process zones utilized in the refining of crude oil materials as described herein.

Suprisingly, when an additive of this invention is mixed with crude oil(s) in the processing thereof as taught herein, but employing refinery equipment which is already at least partially fouled, a reduction in fouling rates and even in the quantity of already formed fouling deposits, can be observed, as indicated.

The process of this invention is characteristically practiced without involving catalysis.

As those skilled in the art of petroleum refining will appreciate, however, one can add to a viscous pitch or the like to be used for a visbreaking operation up to about 25 weight percent (based on 100 weight percent of total mixed system weight) of some hydrocarbon system, such as a distillate from an atmospheric still, as a means for enhancing yield of product condensate from such operation, as known and appreciated by those skilled in the art of petroleum refining, or the like.

In the crude oil processing steps above described, a coker furnace can follow step (G) and precede step (H) so that after step (G) the following processing step sequence occurs after step (G) in place of step (H):

H'. heating said viscous pitch in a furnace to a temperature in the range from about 1000° to 1500° F at a subatmospheric pressure of from about 1 to 5 p.s.i.a., and I'. passing said so heated pitch into a flash zone at temperatures typically in the range from about 860° to 900° F at pressures typically of from about 50 to 350 p.s.i.g.

Such flash zone can either be a coker zone or a visbreaking zone, as above indicated. If a coker zone, residence time in such zone is prolonged and pyrolysis occurs. If a visbreaker zone, residence time is brief and flash distillation occurs.

EMBODIMENTS

The present invention is further illustrated by reference to the following Examples. Those skilled in the art will appreciate that other and further embodiments are obvious and within the spirit and scope of this invention from the teachings of these present Examples taken with the accompanying specification.

EXAMPLE I

Antifouling Evaluation Apparatus and Procedure

Apparatus for accelerated fouling test comprises a feed tank, a nitrogen pressurizing system, a valve and rotameter to control the flow of feed stock from the fuel tank to the heater section and the waste tank, and a heater section which consists of an annular single tube heat exchanger through which the feed stock flows and is heated to field process temperatures. Flow from the feed tank to the waste tank by way of the heat exchanger is accomplished by maintaining the pressure in the waste tank lower than that of the feed tank.

A feed stock entering at the bottom of the exchanger system is at room temperature and the desired pressure. As the feed travels up the exchanger, it is heated to progressively increasing temperatures ranging from about 100° to about 1000°F. During this rapid change in heat content, the feed stock degrades as it slowly passes through the heat exchanger, forming particles which tend to adhere to the exchanger inside surfaces.

The deposits thus formed on the inner walls of the heat exchanger tube in such apparatus depend on the nature of the feed stock and the temperatures applied thereto. Both skin temperature and fluid temperature are significant factors. These deposits may range from a yellow-brown gum or light varnish in the vicinity of the relatively cool end of the tube, to heavy coke at the relatively hot end. The type of deposit on each distinguishable area on the tube is rated visually according to some system, such as the following system:

| Variety of deposit: | Rating No. |
|---|---|
| Clear tube | 0 |
| Tube rainbowing or golden yellow | 1 |
| Light layer of varnish | 2 |
| Medium layer of varnish | 3 |
| Heavy layer of varnish, light coke layer | 4 |
| Moderate layer of coke | 5 |
| Heavy layer of coke | 6 |

Following this visual rating, the rating number assigned to each distinguishable area on the tube is squared and multiplied by the average length of that area. These numbers are added to give a total rating number for each test.

This procedure is illustrated in the following example:

| Type of Deposit | Light Varnish | | Medium Varnish | | Light Coke | | Heavy Coke | |
|---|---|---|---|---|---|---|---|---|
| Rating | 2 | | 3 | | 4 | | 6 | |
| Inches | 4 | | 2 | | 6 | | 1 | |
| | $(2)^2 \times 4$ | + | $(3)^2 \times 2$ | + | $(4)^2 \times 6$ | + | $(6)^2 \times 1$ | |
| | 16 | + | 18 | + | 96 | + | 36 | =166 |

This rating system emphasizes the quality and quantity of coke formed from the thermal decomposition of the feed stock and at the same time takes into acccount deposits formed from gums which are already present in the stock or which form during the heating process.

The test conditions chosen were typical of those encountered in refinery heat exchangers.

Using such apparatus and procedure, there is employed a desalted midcontinent sour crude oil as the feed stock. Various additives are evaluated. Each additive as first dissolved in a solvent of heavy aromatic naptha or water to form a 20 weight percent solution thereof (100 weight percent total weight bases). The additives used, the rates of use, and the results observed are as recorded in Table I below.

The results shown in Table I demonstrate that additive compounds of this invention are useful as antifoulant suppressants in petroleum refining of crude oil feed stocks.

This evaluation also demonstrates that additive ccompounds of the invention are specifically useful in suppressing fouling in a post desalter heat exchanger, and in other subsequent conventional refinery crude oil processing steps, as above explained, employed following a crude oil desalting and refining operation.

EXAMPLE II

Using the same apparatus and procedure of Example I (including feed stock), some of the same additives are retested with the same feed stock, but using reduced rates of additive addition to feed stock which rates are similar to those employed in commerccial refinery operations. The additives used, the rates of use, and the results are indicated in Table II below. It is noted that the higher rates of additive addition to feed stock used in Example I are employed because of the accelerated nature of the test procedure; thus, the higher rates are useful in determining whether or not a particular additive is effective as an antifoulant suppressant.

The additives rates employed in this Example are illustrative of the rates utilized in actual refinery operations. The results shown in

TABLE I

| No. | Additive | Amount Additive Admixed p.p.m. | Tube Rating | % Fouling Reduction (compared to control) |
|---|---|---|---|---|
| 8.a | Untreated control | (none) | 130 | (additive-free-none) |
| 8.1 | $H_3PO_4$ | 300 | 35 | 73 |
| 8.2 | $H_3PO_4$ - Mono Primene 81-R salt | 300 | 40 | 69 |
| 8.3 | $H_3PO_4$ - DI Primene JM-T salt | 300 | 52 | 60 |
| 8.4 | $H_3PO_3$ | 300 | 15 | 88 |
| 8.5 | $H_3PO_3$ - Mono Primene JM-T salt | 300 | 23 | 82 |
| 8.6 | $H_3PO_3$ - DI Primene 81-R salt | 300 | 84 | 35 |

Table II demonstrates that additive compounds of this inventionn are useful as antifoulant suppressant additives in refinery processing of crude oil in equipment as indicated above in Example I.

EXAMPLE III

Using the same apparatus and procedure of Example I (including feestock), certain other additives are evaluated. The additives used, the rates of use and the results are indicated in Table III below.

The results shown in Table III demonstrate that additive compounds of this invention are useful as fouling reducing additives in refinery processing of crude oil.

EXAMPLE IV

The same apparatus and procedure of Example I are used again except that in place of the desalted mid-continent sour crude oil feedstock there is employed as a feedstock the following respective materials:

a. a coker charge feed stock, and b. atmospheric residue fouling in the range from 800° to 1000° F. derived from a desalted mid-continent refinery battery limit crude.

These evaluations are sumarized in Table IV below.

The results shown in Table IV demonstrate that additive compounds used in this invention above are useful as antifoulant reduction additives in refinery processing of reduced crude oil.

TABLE II

| Ex. No. | Additive | Amount Additive Admixed p.p.m. | Comment Relative to Untreated Control |
|---|---|---|---|
| 9.1 | $H_3PO_4$ | 10 | Fouling Reduced |
| 9.2 | $H_3PO_3$ | 10 | Fouling Reduced |
| 9.3 | $H_3PO_3$ - Mono Primene 81-R salt | 10 | Fouling Reduced |

TABLE III

| Ex. No. | Additive | Amount Additive Admixed p.p.m. | Comment Relative to Untreated Control |
|---|---|---|---|
| 10.1 | $H_3PO_2S_2$ | 300 | Fouling Reduced |
| 10.2 | $H_3PO_2S$ | 10 | Fouling Reduced |
| 10.3 | $H_3PO_3$-1-(2-hydroxy ethyl)-2-undecyl imidazoline salt | 300 | Fouling Reduced |
| 10.4 | $H_3PO_4$ - DI Morpholine salt | 10 | Fouling Reduced |
| 10.5 | $H_3PO_3$ - Mono Isopropanol amine salt | 300 | Fouling Reduced |
| 10.6 | $H_3PO_4$-1-(2-hydroxy ethyl)-coco imid-azoline | 10 | Fouling Reduced |

TABLE IV

| Ex. No. | Additive | Feedstock (Particular Feedstock as Indicated in Text) | Amount Additive Admixed with Feedstock (ppm) | Comment (Relative to Untreated Control of Same Feedstock) |
|---|---|---|---|---|
| 11.1 | $H_3PO_2S_2$ - DI cyclo-hexyl amine salt | (a) | 10 | Fouling Reduced |
| 11.2 | $H_3PO_2S$ - Monobutyl amine salt | (b) | 300 | Fouling Reduced |
| 11.3 | $H_3PO_3$ - DI Diethanolamine salt | (a) | 300 | Fouling Reduced |
| 11.4 | $H_3PO_4$ - Mono Tallow amine salt | (b) | 300 | Fouling Reduced |
| 11.5 | $H_3PO_3S$ | (a) | 10 | Fouling Reduced |
| 11.6 | $H_3POS_2$ | (b) | 300 | Fouling Reduced |
| 11.7 | $H_3PO_3$ - Polyamine H salt | (a) | 10 | Fouling Reduced |

EXAMPLE V

Refinery battery limit crude oil (midcontinent sour) is continuously fed to a desalter preheater and heated to a temperature in the range from about 150° to 180°F. Such preheated crude is then continuously charged to a desalter.

In the desalter, water is turbulently mixed with the crude oil at a rate of from about 3 to 8 parts by weight of water for each 100 parts by weight of said crude oil thereby forming an emulsion of the water in oil type.

The resulting emulsion iis than passed through grids across which an electric field of 2000–4000 volts per inch is maintained as a result of which the emulsion is broken. The resulting water phase is collected and discarded. A Howe-Baker Engineers Desalter unit is used which is equipped with a Three Type SVS Electrode. The resulting desalted oil phase is collected and is removed and charged continuously to a series of three post desalter heat exchangers wherein such crude oil is heated to a temperature in the range of from about 300° to 450°F continuously. Next, the so-heated crude oil is passed into a furnace wherein the temperature of the oil is further raised to a value in the range from about 550° to 600°F. The resulting so heated crude oil is then charged to an atmospheric pipe still wherein, by fractional distillation, three distillate fractions are produuced and collected, which are identified as follows:

1. A light-run fraction consisting primarily of $C_5$ and $C_6$ hydrocarbons, but also containing any $C_4$ and higher gaseous hydrocarbons present and dissolved in the starting crude oil.

2. A naphtha fraction having a nominal boiling range of from about 150° to 275° F (71°–135° C).

3. A kerosene with a boiling range of from about 250° to 485° F (127° to 252° C).

The residual crude oil (or atmospheric residue) remaining boils at a temperature of from about 350° to 650° F.

The atmospheric pipe still and the vacuum still used are each equipped with numerous trays through which the hydrocarbon vapors pass in an upward direction. Each tray contains a layer of liquid through which the vapors can bubble and the liquid can flow continuously by gravity in a downward direction from one tray to the next one below. As the vapors pass upward through the succession of trays, they become lighter (lower in molecular weight and more volatile), annd the liquid flowing downward becomes progressively heavier (higher in molecular weight and less volatile). This countercurrent action results in a fractional distillation or separation of hydrocarbons based on their boiling points. Liquids are withdrawn from preselected trays as a net product, the lighter liquids such as naphtha being withdrawn from trays near the top of the column, and the heavier liquids, such as diesel oil, being withdrawn from the trays near the bottom. The boiling of the net product liquid depends on the tray from which it is taken. Vapors containing the $C_8$ and lighter hydrocarbons are withdrawn from a top region of the distillation column as a net product, while a liquid stream boiling higher than about 650° F (343° C) is removed from a bottom region of the distillation column. This product liquid stream is sometimes called the atmospheric residue.

This atmospheric residue is now further heated in a vacuum furnace to a temperature in the range of from about 650° to 800° F while maintaining a subatmospheric pressure of from about 5 to 14 psia. This so heated resulting residual crude oil is then progressively fractionally distilled in a vacuum still at temperatures in the range of from about 800 to 1000°F under subatmospheric pressures ranging from about 1 to 5 psia. The distillate collected comprises a heavy gas oil having a boiling range of from about 650° to 1050° F (343° to 566° C). The residue remaining is a substantially non-distillable residual viscous pitch which has a temperature in the range of from about 1000° to 1500° F at a pressure of from about to 5 psia.

This pitch material is then continuously charged to a coker furnace which is maintained at pressures of from about 30 to 50 psig, annd temperatures in the range from about 750° to 920° F and the resulting heated pitch is then charged to a coker zone. The resulting distillates produced by pyrolysis are collected and separated until finally a solid coke product is obtained. The pitch charged to such coking unit results in naptha and gas oil distillates and coke residues as main products.

The crude oil and the atmospheric residue are brought to their desired temperatures in tubular heaters (furnaces). Oil to be heated is pumped through the inside of the tubes which are contained in a refractory combustion chamber fired with oil or fuel gas in such manner that heat is transferred through the tube wall in part by convection from hot combustion gasses and in part by radiation from the incandescent refractory surfaces.

This crude oil processing arrangement is equipped with a series of sleeve-type arrangements termed quills for purposes of injecting additives into the process streams involved. Thus, one quill is located in the feed line to the pre-desalter heat exchanger (termed, in Table VI, quill No. 1). Another quill is located between the desalter unit and the post desalter heat exchanger (termed quill No. 2). Another quill is located in the line between the post desalter heat exchanger and the furnace (termed quill No. 3). Another quill is located aligned between the furnace and the atmospheric pipe still (termed quill No. 4). Another quill is located in the line between the bottom liquid stream (the atmospheric residue) from the atmospheric pipe still and the vacuum furnace (termed quill No. 5). Another quill is located in the line between the vacuum furnace and the vacuum columnn (termed quill No. 6). Finally, another quill is located in the line between the vacuum still and the coker zone (termed quill No. 7).

A series of solutions are prepared of various additive compounds of this invention. The solvent in all cases is generally a heavy aromatic hydrocarbon (petroleum derived) having a boiling point in the range of from about 300° to 650° F. The additives used and the concentration of such additives in each respective solution are summarized in Table V below.

The equipment train here involved has a capacity to process at least about 1,000 barrels of crude oil daily. Before being equipped with quills as above described, this equipment had been in use for a period of time in excess generally of about 3 months and the interior walls of substantially all of the pieces of equipment involved were known to carry substantial fouling deposits thereon.

Varioous individual solutions as above described are injected into the various process streams which are quill equipped as above described at specified rates of injection for specified intervals of time at the end of which the equipment downstream from the point of injection is investigated to determine the extent of fouling or the condition of fouling associated therewith if such condition is then compared to the starting condition. Details and results are tabularized in Table VI. As Table VI indicates, the additive compounds of the invention are effective in controlling and in actually reducing the fouling of internal refinery equipment surfaces. Reduction in fouling of previously fouled equipment is demonstrated by decrease in pressure drop or an increase in temperature at a given process stream point achieved after use as shown in Table VI of this Example invention for periods of 20 to 30 days.

EXAMPLE VI

An equipment train like that described above in Example 5 which has been in prolonged use (e.g. about 3 months) and is known to be fouled is employed except that here, in place of the thermal coking unit there is employed a thermal cracking unit (visbreaking) for further processing pitch from the vacuum column. In this unit the pitch is processed under relatively mild conditions to reduce its vicosity, (for times of about 1–2 seconds at temperatures ranging from about 800° to 900° F).

The equipment is provided with quills in a manner similar to that described in the preceding example except that here the last quill precedes the thermal cracking unit.

Solutions of additive compounds of this invention are prepared as described in the preceding example and as shown in Table V and are used similarly to the manner described in the preceding Example. The results are tabularized below in Table VII. The results indicate that the additive compounds of this invention are effective in reducing fouling. Fouling normally readily occurs in the visbreaker preheat process train and is substantially reduced by the practice of this invention.

TABLE V

| Ex. No. | Additive Type | Concentration of Additive in Solution (wt.%) | Solvent (Characterization for each solvent given by footnotes) |
|---|---|---|---|
| 12a | $H_3PO_4$ - Mono Primene 81-R salt | 25 | Exxon Heavy Aromatic Solvent[1] |
| 12b | $H_3PO_3$ - DI Primene JM-T salt | 10 | Texaco Aromatic Solvent[2] |

TABLE V-continued

| Ex. No. | Additive Type | Concentration of Additive in Solution (wt.%) | Solvent (Characterization for each solvent given by footnotes) |
|---|---|---|---|
| 12c | $H_3PO_3$ | 20 | Water |

[1]90–95% Aromatics, Boiling Range 318–600° F.
[2]95–98% Aromatics, Boiling Range 401–662° F.

TABLE VI

| Ex. No. | Additive Solution No. | Total Additive Conc. in PPM Based on Initial Crude Charge Rate | Quills Where Added 1 | 2 | 3 | 4 | 5 | 6 | 7 | Total Time Additive So Added At Each Quill | Fouling Results |
|---|---|---|---|---|---|---|---|---|---|---|---|
| 12.1 | 12a | 20 | — | 20 | — | — | — | — | — | 6 Mo. | Fouling Reduced |
| 12.2 | 12b | 20 | 10 | 10 | — | — | — | — | — | 6 Mo. | |
| 12.3 | 12c | 30 | — | 10 | 10 | — | 10 | — | — | 9 Mo. | |
| 12.4 | 12a | 40 | — | 20 | — | — | 10 | — | 10 | 3 Mo. | |
| 12.5 | 12b | 50 | 10 | 20 | 10 | — | 10 | — | 10 | 4 Mo. | |
| 12.6 | 12c | 25 | — | — | 15 | — | 10 | — | — | 9 Mo. | |
| 12.7 | 12a | 20 | — | — | — | 10 | — | 10 | — | 2 Yrs. | |
| 12.8 | 12b | 25 | — | — | — | — | — | — | 25 | 4 Mo. | |
| 12.9 | 12c | 20 | 10 | — | — | — | — | — | 10 | 1 Yr. | |

TABLE VII

| Ex. No. | Additive Solution No. | Total Additive Conc. in PPM Based on Initial Crude Charge Rate | Quills Where Added 1 | 2 | 3 | 4 | 5 | 6 | 7 | Total Time Additive So Added at Each Quill | Fouling Results |
|---|---|---|---|---|---|---|---|---|---|---|---|
| 13.1 | 12a | 25 | — | — | — | — | — | — | 25 | 6 Mo. | Fouling Reduced |
| 13.2 | 12b | 35 | — | — | — | — | — | — | 35 | 9 Mo. | Fouling Reduced |
| 13.3 | 12c | 15 | — | — | — | — | — | — | 15 | 6 Mo. | Fouling Reduced |

The claims are:

1. In a method for reducing fouling of surfaces contacted with crude oils and residual crude oils during refinery processing thereof, said refinery processing comprising a successive series of continuously practiced steps including:

A. heating a crude oil in a heat exchanger to a temperature in the range from about 100° to 200° F., B. desalting said crude oil by the substeps of 1. turbulently mixing with the so heated crude oil from about 3 to 8 parts by weight of water for each 100 parts by weight of said crude oil,
2. breaking said emulsion, and
3. separating the resulting aqueous phase from the resulting crude oil phase, C. further heating said resulting crude oil in a post desalter heat exchanger to a temperature in the range from about 200° to 500° F., D. still further heating said resulting crude oil in a furnace to a temperature in the range from about 500° to 700°F., E. fractionally distilling in an atmospheric still, the so heated, crude oil at temperatures ranging from about 300° to 650° F. and at pressures ranging from and including atmospheric up to about 40 psia. and condensing the distillates until an atmospheric residue remains which boils above a temperature in the range from about 300° to 650° F., F. heating said atmospheric residue in a furnace to a temperature in the range from about 650° to 800° F while maintaining subatmospheric pressure of from about 5 to 14 psia., G. fractionally distilling in a vacuum still the so heated atmospheric residue at temperatures ranging from about 800° to 1000° F, under subatmospheric pressures of from about 1 to 5 psia and condensing the distillates until a viscous pitch results H. heating said viscous pitch in a furnace to a temperature in the range from about 1000° to 1500° F at subatmospheric pressures of from about 1 to 5 psia and I. passsing said so heated pitch into a flash zone maintained at a temperature in the range from about 860° to 900° F at pressures ranging from about 50 to 350 psig., the improvement which comprises the steps of:

a. admixing with at least one material selected from the group consisting of said crude oil, said atmospheric residue, and said viscous pitch a small amount of at least one additive preceding at least one of the respective and processing steps in said series designated above as (A) through (I), and thereafter b. subjecting such resulting mixture to the remaining successive processing step(s) in said series, said additive being at least one compound selected from the group consisting of amine salts of inorganic phosphorus containing acids.

2. The process of claim 1 wherein each of said additive is so mixed at a rate of from about 2 to 50 parts per million by weight with said material.

3. The process of claim 1 wherein said additive is first dissolved in a heavy aromatic hydrocarbon having a boiling point in the range from about 350° to 550° F before being admixed with said material.

4. The process of claim 1 wherein said additive is initially continuous admixed at a rate of from about 2 to 50 parts per million and, then, thereafter, following a period of such admixture of at least about 1 week, said additive is continuously admixed at a rate of from about 5 to 20 parts per million for a period in excess of 1 week.

5. The process of claim 1 wherein said additive is so admixed preceding at least two of said respective processing steps.

6. The process of claim 1 wherein said additive is simultaneously so admixed preceding at least steps (A), (C), (F), and (H).

7. The process of claim 1 wherein said surfaces so contacted are preliminarily fouled with deposits from crude oil material during refinery processing thereof.

* * * * *